US009204689B2

(12) United States Patent
Gonzalez

(10) Patent No.: US 9,204,689 B2
(45) Date of Patent: Dec. 8, 2015

(54) ELASTIC CORD HAVING TAPERED PROTRUDING PORTIONS

(71) Applicant: Quest Technologies, Inc., Denver, CO (US)

(72) Inventor: Miguel A. Gonzalez, Castle Rock, CO (US)

(73) Assignee: QUEST TECHNOLOGIES, INC., Denver, CO (US)

( * ) Notice: Subject to any disclaimer, the term of this patent is extended or adjusted under 35 U.S.C. 154(b) by 111 days.

(21) Appl. No.: 13/854,660

(22) Filed: Apr. 1, 2013

(65) Prior Publication Data

US 2013/0255045 A1 Oct. 3, 2013

Related U.S. Application Data

(60) Provisional application No. 61/618,575, filed on Mar. 30, 2012.

(51) Int. Cl.

| | |
|---|---|
| ***A43C 9/00*** | (2006.01) |
| ***A43C 13/00*** | (2006.01) |
| ***A43C 1/00*** | (2006.01) |

(52) U.S. Cl.

CPC . *A43C 9/00* (2013.01); *A43C 1/003* (2013.01); *A43C 13/00* (2013.01); *Y10T 24/3787* (2015.01)

(58) Field of Classification Search

CPC ..... A43C 13/00; A43C 1/003; A43C 9/00; Y10T 24/3787

USPC ..... 24/300, 712, 712.7, 713.6, 715.3

See application file for complete search history.

(56) References Cited

U.S. PATENT DOCUMENTS

| | | | | |
|---|---|---|---|---|
| 4,423,539 | A * | 1/1984 | Ivanhoe | 24/715.3 |
| 5,964,742 | A | 10/1999 | McCormack et al. | |
| 6,513,210 | B1 * | 2/2003 | Gonzalez | 24/712 |
| 7,549,201 | B2 * | 6/2009 | Kraft et al. | 24/713 |

(Continued)

FOREIGN PATENT DOCUMENTS

| | | |
|---|---|---|
| EP | 1795085 | 6/2007 |
| FR | 2971676 | 8/2012 |

OTHER PUBLICATIONS

International Search Report, International Searching Authority, Jul. 3, 2013, pp. 1-9.

*Primary Examiner* — Robert J Sandy
*Assistant Examiner* — David Upchurch
(74) *Attorney, Agent, or Firm* — Samuel M. Freund; Cochran Freund & Young LLC

(57) ABSTRACT

An elastic cord having at least one tapered protruding portion along its length, wherein the extent of protrusion is reduced when the cord is axially stretched, and returns to its original size when the cord is relaxed, is described. One embodiment includes an elastic core about which a flexible sheath is fitted, wherein chosen axially spaced-apart portions of the sheath form tapered isolates or knots in accordance with selected patterns for protrusions therein when the elastic core is in its relaxed state. Such knots are formed when the sheath is cause to bunch up at these axial locations. Sheath patterns may be achieved by employing a woven structure for the sheath. The protruding portions or knots reversibly resist movement of the elastic cord through an opening having a chosen size, such as an eyelet of a shoe. When a unidirectional force is applied to the cord whereby the cord is stretched, the extent of the protruding portion or knot may be sufficiently reduced to enable the cord to be drawn through the opening.

19 Claims, 5 Drawing Sheets

(56) References Cited

U.S. PATENT DOCUMENTS

D606,296 S * 12/2009 Mouton ..... D2/978
2011/0047822 A1 3/2011 Pape
2012/0232655 A1 9/2012 Lorrison et al.

* cited by examiner

ELASTIC CORD HAVING TAPERED PROTRUDING PORTIONS

CROSS-REFERENCE TO RELATED APPLICATIONS

The present application claims the benefit of U.S. Provisional Patent Application No. 61/618,575 for "Elastic Cord Having Tapered Protruding Portions" which was filed on Mar. 30, 2012, the entire content of which is hereby specifically incorporated by reference herein for all that it discloses and teaches.

FIELD OF THE INVENTION

Embodiments of the present invention relate generally to cord for fastening or holding items in place and, more particularly, to elastic cord for threading through an opening such as an eyelet, for use in fastening or holding various articles, such as clothing items including shoes, hats, shirts, pants, coats, and belts, as examples; for fastening or holding containers, such as bags, back packs, and satchels; and for fastening together or holding various other items which are conventionally held or fastened by rope, string, thread, cloth, and bungee cords, as examples.

BACKGROUND OF THE INVENTION

Adjusting laced shoes to fit a wearer's foot is presently achieved by drawing a shoelace through eyelets, tightening the lace and tying the loose portions of the lace into a knot. Mechanical fastening devices such as latches, hooks or clamps designed for holding cords, ropes, or strings may also be utilized for adjusting cord tension. However, such closures break frequently and are relatively expensive, and many designs are cumbersome making fastening, unfastening and adjustments difficult.

Conventional shoestrings and mechanical fasteners have a number of limitations and drawbacks. For example, shoestrings tied into knots may loosen with use of the shoe or other footwear. In particular, shoelaces tend to naturally migrate toward the bend of a shoe causing increased pressure on the instep of the foot and excessive slipping about the metatarsal.

SUMMARY OF THE INVENTION

Embodiments of the present invention overcome the disadvantages and limitations of prior art fastening devices by providing cord effective for reversibly restricting movement of the cord through an opening, such as a shoe eyelet.

Another object of the invention is to provide cord effective for reversibly restricting movement of the cord through an eyelet, such as a shoe eyelet, while permitting the cord to be independently adjusted at each eyelet.

Yet another object of embodiments of the invention is to provide an elastic cord adapted to reversibly restrict movement of the cord through an eyelet, whereby the cord may be readily drawn through the eyelet by stretching the elastic cord in at least one direction to sufficiently reduce the restriction for movement through the eyelet.

Still another object of the invention is to provide cord that can be used to reversibly fasten, tie or adjust an article without requiring a knot or mechanical device for fastening or preventing unfastening of the cord.

Another object of the invention is to provide a shoelace for restricting the natural migration of laces toward the bend of a shoe.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention as embodied and broadly described herein, the elongated cord for threading through an opening, the cord having an axis, hereof includes: an elastic core; and a flexible sheath surrounding the elastic core forming at least two intermediate portions where the sheath is anchored to the core, each intermediate portion having a first diameter adapted to be threaded through the opening, and at least one outwardly expandable protruding portion having a second diameter at its largest extent when the core is unstretched, disposed between two of the at least two intermediate portions, and at least one tapered portion for transitioning the protruding portion into one of the intermediate portions along the axis, the protruding portion and the at least one tapered portion being unanchored to the core, wherein the second diameter is reduced when the core is stretched a first amount, thereby enabling the at least one protruding portion to be drawn through the opening, and wherein the at least one protruding portion assumes a third diameter at its largest extent, less than or equal to the second diameter, effective for resisting movement of the at least one protruding portion through the opening responsive to the core being stretched a second amount less than the first amount, wherein the two intermediate portions move towards each other.

In another aspect of the present invention, and in accordance with its objects and purposes, the elongated cord for threading through an opening, said cord having an axis, comprising: an elastic core having at least two intermediate portions having a first diameter adapted to be threaded through the opening, and at least one, protruding portion having a second diameter at its largest extent when the core is unstretched, disposed between two of the at least two intermediate portions, and at least one tapered portion for transitioning the protruding portion into one of the intermediate portions along the axis, wherein the second diameter is reduced when the core is stretched a first amount, thereby enabling the at least one protruding portion to be drawn through the opening, and wherein the at least one protruding portion has an elastic memory for enabling the at least one protruding portion to return to a third diameter at its largest extent, less than or equal to the second diameter, effective for resisting movement of the at least one protruding portion through the opening, responsive to the core being stretched a second amount less than the first amount, wherein the two intermediate portions move towards each other.

Benefits and advantages of embodiments of the present invention include, but are not limited to, providing an elastic cord that can be used in cooperation with an opening having a chosen size, for fastening, tying or adjusting an object without requiring a knot or a mechanical device for fastening, or preventing unfastening or slippage of the cord through the opening. The cord may be independently adjusted at each opening.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings:

FIG. 5*a* is a graph of an example of the weave pattern density of the sheath as a function of the distance along the sheath for a chosen protruding portion which generates the symmetric tapered protruding portions of FIGS. 2 and 3 hereof, while

DETAILED DESCRIPTION

Figure 1:
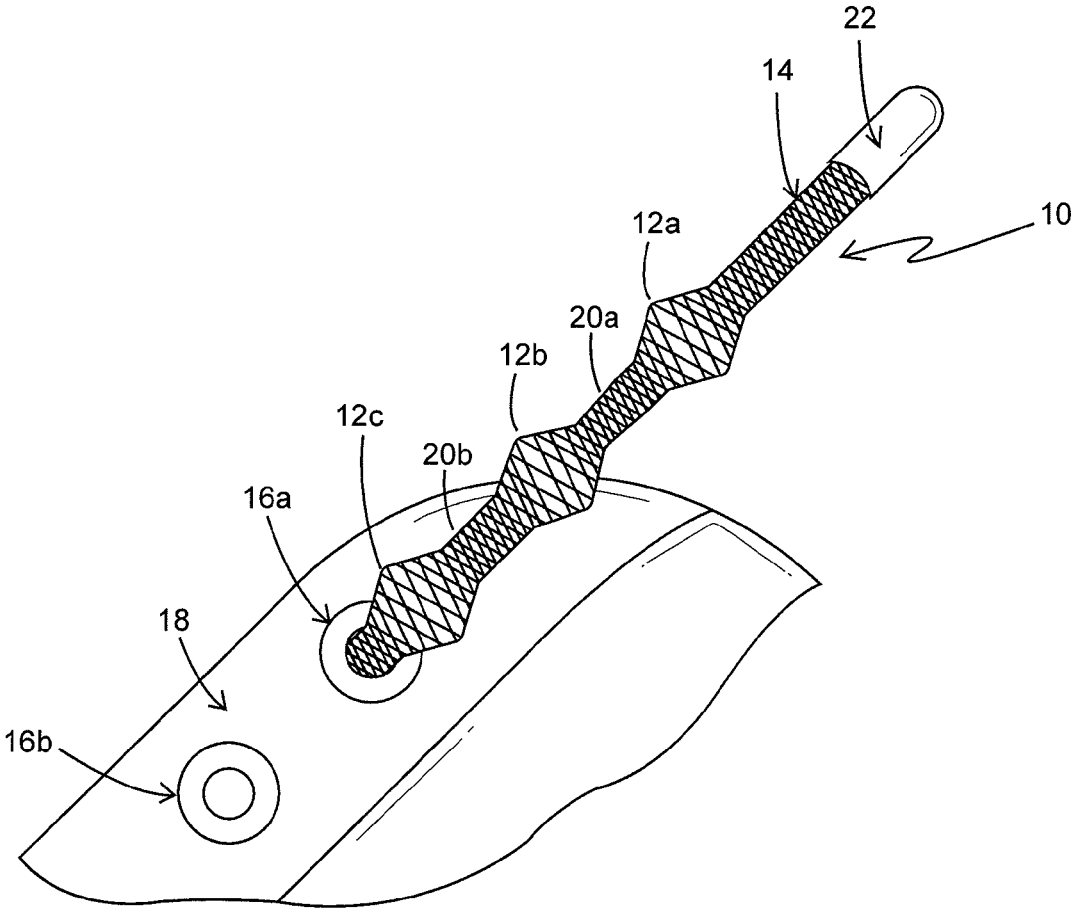
FIG. 1 is a schematic representation of a perspective view of an embodiment of the sheathed elastic cord of the present invention illustrating a series of symmetric tapered protruding portions for reversibly preventing the cord from moving through an opening formed by an eyelet.

Briefly, embodiments of the present invention include an elastic cord having at least one protruding portion, isolate or bulge formed along its length, wherein the protruding portion has at least one axially disposed tapered transition portion, and wherein the extent of protrusion of the bulge being diminished or reduced when the cord is axially stretched, and returning to its original size when the cord is relaxed. In one embodiment, a length of elastic cord has a number of tapered protrusions defined at chosen axially spaced positions thereon. Other embodiments provide an elastic core about which a flexible sheath is fitted. Chosen axially spaced-apart portions of the sheath form tapered isolates or knots in accordance with selected patterns for protrusions in the sheath when the elastic core is in its relaxed state. Such knots are formed when the sheath is cause to bunch up at these axial locations, and may include some outward expansion of the core itself. Sheath patterns may be achieved by employing a woven structure for the sheath.

The expanded portions or isolates have sufficiently large diameters to resist movement of the cord through an opening having a chosen size. When tension is unidirectionally applied to the cord in any direction at the opening, the elastic cord is elongated (axially stretched), and the outer diameter of the isolate becomes sufficiently reduced to enable the cord to be drawn through the opening. Thus, the embodiments of the isolates of the present invention provide a reversible resistance to motion of a cord or lace through an opening; that is, the holding ability of the isolate against an opening may be diminished to the point where the cord is readily drawn through the opening, as the cord is elongated. Additionally, in accordance with the teachings of the present invention, the elastic cord may be independently adjusted at each eyelet of an article secured therewith.

In what follows, the terms: isolate, knot, knob, bulge, protuberance, protruding portion, protrusion, expandable portion, outwardly expandable component, outwardly expandable tapered component, and outwardly expandable protruding portion, both symmetric and asymmetric will be used interchangeably. The terms: opening and eyelet, as applied to shoes and other footwear as examples, and to mechanical fasteners, such as open hook eyelets and barrel locks, will be used interchangeably herein. Additionally, the term "restrict" refers to the situation where the knot or isolate resists movement through an opening under normal use, but where the outward extent or outer diameter of the protrusion may be sufficiently reduced in size when the elastic cord is axially stretched or elongated, such that the knot or isolate may pass through the opening. This secures the portion of the shoe upper or clothing, pack or other device, as long as the cord is in a relaxed or unstressed state. Elongated or intermediate portions refer to sections along the cord between the outwardly expandable components or between the outwardly expandable components and the tip of the cord.

In U.S. Pat. No. 6,513,210 for "Draw-Tight Elastic Cordage," which issued to Miguel A. Gonzalez on Feb. 4, 2003, flared isolates are described for preventing unintended shifts or movements of the elastic cord through an opening. The cord is stretched from both sides of the opening in order to sufficiently compress the isolate to permit movement of the cord through the opening. Otherwise, attempts to pull an isolate through an opening from one direction may jam the isolate therein since cord material may build up behind the opening, causing destruction of the eyelet and/or the cord. By contrast, as stated hereinabove, the tapered protrusions of the present invention may readily be reduced in size by unidirectionally stretching the elastic cord in the direction of choice at the opening.

Reference will now be made in detail to the present embodiments of the invention, examples of which are illustrated in the accompanying drawings. In the FIGURES, similar structure will be identified using identical reference characters. It will be understood that the FIGURES are for the purpose of describing particular embodiments of the invention and are not intended to limit the invention thereto. Turning now to FIG. 1, a schematic representation of a perspective view of an embodiment of sheathed elastic cord, 10, is shown illustrating a series of symmetric tapered protruding portions, 12*a*-12*c*, in flexible sheath, 14, for reversibly preventing cord 10 from being drawn through an opening formed by eyelet, 16*a* (16*b*, showing another eyelet), in shoe, 18, with smaller diameter intermediate portions, 20*a* and 20*b*, into which tapered protruding portions 12*a*-12*c* transition in the axial direction, therebetween. Smaller diameter intermediate portions 20*a* and 20*b* are adapted to be threaded through eyelet 16*a*. Tip (aglet), 22, is a plastic or metal end member attached to opposite ends of many shoestrings.

Figure 2:
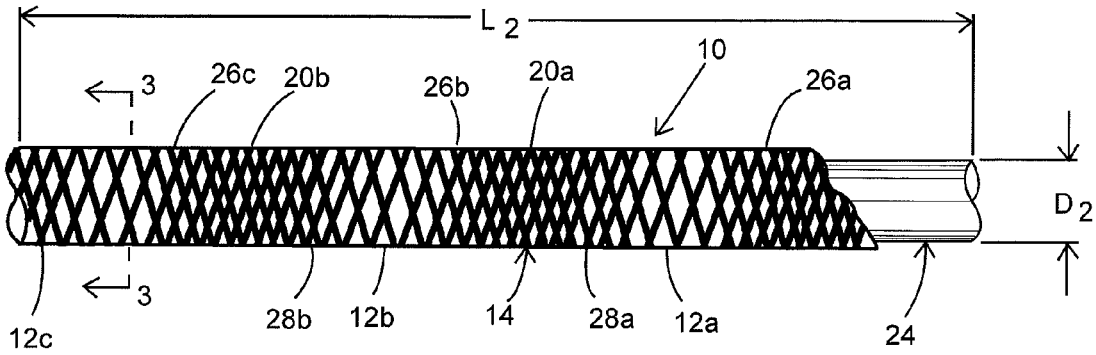
FIG. 2 is a schematic representation of a side elevational view, partially cut away, showing portions of the sheathed elastic cord of FIG. 1, wherein the symmetric tapered protruding portions collapse when the cord is elongated.

FIG. 2 is a schematic representation of a side elevational view, partially cut away, showing portions of sheathed elastic cord 10 of FIG. 1, wherein symmetric tapered protruding portions 12*a*-12*c* collapse to similar sizes to that for the intermediate portions 20*a*, 20*b* when cord 10 is axially stretched to length $L_2$. Illustrated also in FIG. 2 is elongate elastic core, 24, which is surrounded by sheath 14 forming cord 10. In its stretched condition, core 24 is shown to have outer diameter $D_2$, with sheath 14 having a slightly larger outer diameter throughout, depending on the thickness of the sheath.

Figure 3:
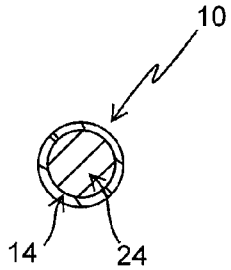
FIG. 3 is a schematic representation of a cross sectional view taken along line 3-3 of FIG. 2 hereof.

FIG. 3 is a schematic representation of a cross sectional view taken along line 3-3 of FIG. 2 hereof.

Figure 4:
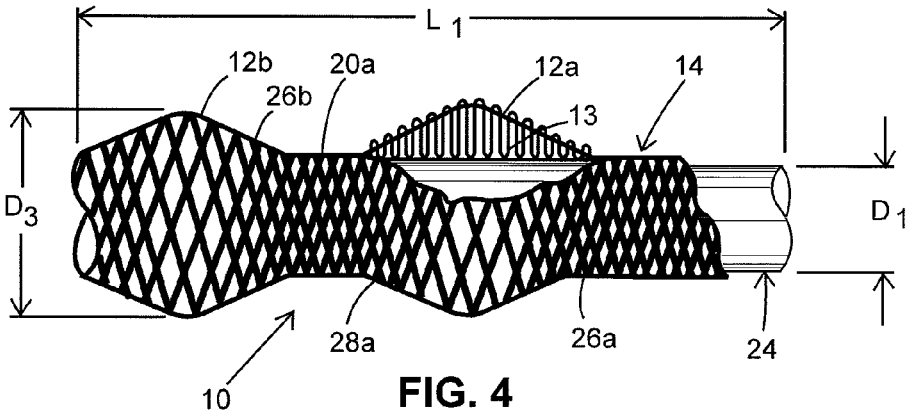
FIG. 4 is a schematic representation of a side elevational view similar to that of FIG. 2 hereof showing the sheathed elastic cord in an untensioned condition, wherein the symmetric tapered protruding portions are fully formed.

FIG. 4 is a schematic representation of a side elevational view similar to that of FIG. 2 hereof showing sheathed elastic cord 10 in an untensioned condition, having length $L_1$, shorter than length $L_2$, wherein the symmetric tapered protruding portions 12*a* and 12*b* are illustrated as having diameter $D_3$, are fully formed. As will be described in more detail hereinbelow, tapered protruding portions or isolates 12*a* and 12*b* are formed when sheath 14 is caused to bunch up at these locations. Bunching is schematically illustrated in the cutaway portion of sheath 14 by reference character, 13, and again in FIG. 8, hereinbelow. Some contribution to the isolate may derive from the core itself. The portion of the sheath shown below the cutaway portion is bunched as well, but is illustrated as having loosely braided fibers for purposes of illustration of the graded fiber pattern to be described hereinbelow; similarly, for FIG. 8 hereinbelow.

Core 24 is shown having a solid cylindrical shape, but other shapes may be envisioned. Core 24 may be formed from an elastomeric material such as natural rubber, or a suitable synthetically produced material such as butyl rubber, neoprene, or Elvax® (ethylene vinyl acetate), as examples, which elongate when tensioned, such as when a user pulls on an end or ends of the core. Core 24 may comprise multiple elastic fibers, or multiple elastic fibers blended or woven with nylon fibers, as an example, or other fibers, in a matrix for increasing the tensile strength of the core and/or for restricting the elongation of the core under tension. Flexible sheath 14 may be formed as a braided matrix comprising threads of a suitable material such as cotton, polyester, nylon, acrylic or an elastic material, such as Spandex®.

Cord 10 may be manufactured by first axially stretching core 24. The stretching causes a portion of the core to elongate to a length $L_2$, as shown in FIG. 2, and assume an outer diameter $D_2$. A braiding machine, which may be of conventional design, is used to weave or braid a chosen pattern of threads or strands about core 24 in its stretched condition. The machine creates a repetitive series of chosen braid patterns along the core's length. First, braid patterns 20*a* and 20*b* are tightly-woven, constant weave patterns formed with a sufficiently tight braid to frictionally grip or anchor on the core when the core is relaxed. A second pattern, 26*a*, and, 28*a*, and 26*b*, and, 28*b*, formed on either side of protruding portions 12*a* and 12*b*, respectively, are weave patterns having decreasing density (increased spacing) of fibers from that of tightly woven braid patterns 20*a* and 20*b* until the center portion of protrusion 12*a* or 12*b* is reached, and then increasing fiber density (decreased spacing) until the fiber density of the tightly woven braid pattern on the other side of protruding portion 12*a* or 12*b* is attained, thereby attaining a smooth transition. The braids are sufficiently loose to enable sheath 14 to be unanchored to the core 24, in these portions along core 24, as is shown in FIG. 4, hereof, where sheath 14 is shown as separating from core 24. As stated hereinabove, the protrusions or isolates are formed principally by the bunching up 13 of the sheath in the regions of decreased fiber spacing when core 24 is permitted to relax.

After the braiding operation is completed the tensile stress is removed to enable the core to assume its relaxed state having length $L_1$ as shown in FIGS. 1 and 4. In this state the core segment length contracts to $L_1$, while the outer diameter expands to $D_1$. The contraction of core 24 causes intermediate sheath portions 20*a* and 20*b* to move toward each other which in turn causes protruding portions 12 to bunch up and outwardly protrude to diameter $D_3$ with tapered transitions under the control of the chosen braid pattern. Appropriate selection of the core and sheath material type, size, proportions, and sheath braiding pattern results in $D_3$ being sufficiently large relative to the inner diameter of eyelet opening 16*a* so that the bunched up mid-portions resist threading movement of the cord in one direction through the opening. The diameters of intermediate portions 20 are chosen such that they readily pass through eyelets 16 when the cord is not under tension. Thus, as shown in FIG. 1 tapered protrusion 12*c* is larger than the inner diameter of opening 16*a* to resist inward movement of the cord through this eyelet. If there is another similarly protruding portion (not shown in FIGS. 1 and 4) on the other side of the eyelet in FIG. 1, then the cord would be prevented from being drawn through the eyelet in the opposite direction. The protrusion restricts movement of the cord under normal use. Such restriction is reversible since the knot may be reduced in size whereby it can pass through the opening when a unidirectional force is applied to cord 10 such that cord 10 is sufficiently stretched. Cord 10 may be stretched by applying force from either side of eyelet 16*a* from knot 12*c*. The portion of the shoe upper or clothing, pack or other device may thereby be tied down or otherwise secured.

The tightest woven portions of intermediate portions 20*a* and 20*b* may also be bonded to core 24, while the remaining portions of sheath 14 are not attached to the core, thereby enabling outward flexible bulging or expansion into chosen-shaped enlargements 12*a* and 12*b* as shown in FIGS. 1 and 4 hereof. The tightly braided portions may also be attached to core 24 using stitches which penetrate through the sheath and into the core at axially spaced-apart positions when the core is under tensile stress, or otherwise bonded thereto. As stated, when the tensile stress is released, core 24 contracts such that protrusions are formed effective for resisting threading of cord 10 through an appropriately sized eyelet or other opening.

As stated, when it is desired to release the cord, the user may pull on one or both ends of cord 10 to apply sufficient tension so that core elongates toward its length $L_2>L_1$ while the core contracts toward a diameter $D_2<D_1$. Elongation of the core in each segment pulls the sheath end portions apart, which in turn stretches the protrusions which contract from diameter $D_3$ to a size which is smaller than opening in eyelet 16*a*. The cord can then be threaded through the opening to either release or readjust the article or device being fastened or tied down. Due to the tapered nature of the protrusion in accordance with the teachings of the present invention, the cord need only be stretched in the direction of the opening since the taper assists in the process of reducing the isolate dimensions such that it may be threaded through the opening.

Figure 5A:
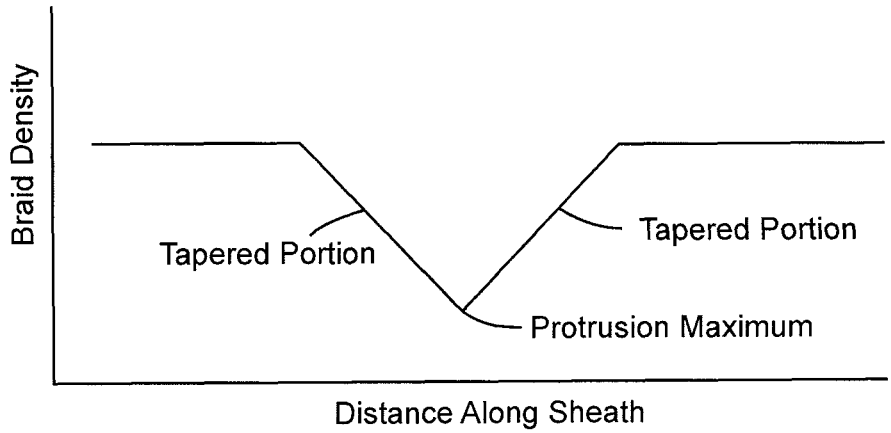
Figure 5B:
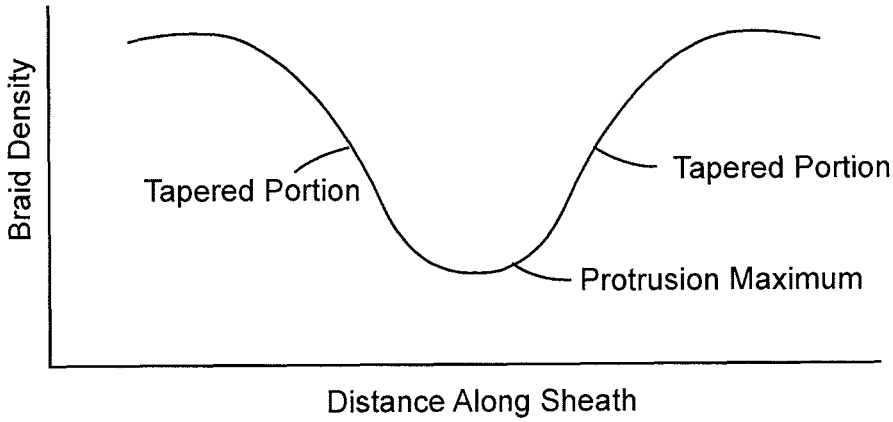
FIG. 5*b* is a graph of another example of the weave pattern density of the sheath as a function of the distance along the sheath for a chosen protruding portion which generates another symmetric tapered protruding portion configuration.

FIG. 5*a* is a graph of an example of the density of the weave or braiding of the sheath as a function of the distance along the sheath for a chosen protruding portion which generates the symmetric tapered protruding portions of FIGS. 2 and 3 hereof, while FIG. 5*b* is a graph of another example of the density of the weave of the sheath as a function of the distance along the sheath for a chosen protruding portion which generates a similar symmetric tapered protruding portion configuration.

Figure 6:
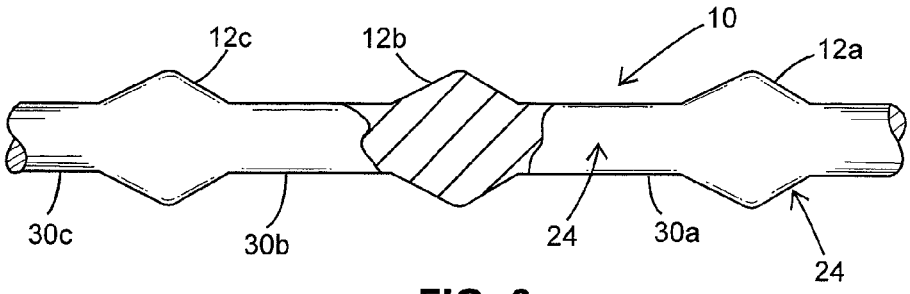
FIG. 6 is a schematic representation of a side elevation view of an unsheathed embodiment of the elastic cord of the present invention having symmetric tapered protruding portions.

FIG. 6 is a schematic representation of a side elevation view of an unsheathed embodiment of elastic cord 10 of the present invention having symmetric tapered protruding portions. Cord 10 may comprise core 24 formed by an extrusion process from a suitable elastic extrudable material, such as an elastic resin, a polymer, for example, ethylene vinyl acetate, a thermosetting plastic or rubber. The cord has one or more elongated portions 30*a*-30*c* and one or more outwardly expandable tapered protruding portions 12*a*-12*c* which are axially spaced apart, and transition into elongated portions 30*a*-30*c*. The illustrated embodiment shows a uniform pitch distance (1 cm, as an example) between the expandable components, but a variable pitch distance could be provided as required by a particular application.

The material may be extruded through a suitable die or nozzle (not shown in FIG. 6) which forms an extrudate having a cross-sectional shape conforming to that of the die. The die cross-section may be round, oval or other geometric shape, as desired. In some situations, controlled amounts of air or other gas may be injected into the extrudate at the positions where the symmetrical tapered protrusions are to be formed, which enables the protrusions to be more readily collapsed. A nozzle (not shown in FIG. 6) for injecting the air may extend concentrically through the extrusion die, such that intermittent pulses of pressurized air may be injected into the molten extrudate, forming thereby the spaced-apart symmetrical protrusions shown in FIG. 6. The expandable components may also be formed by drawing a vacuum by suitable apparatus upstream of the cooling bath. After the extrudate cures, the cord may be axially stretched such that the expandable components shrink to a diameter which is sufficiently small to enable the cord to pass through the desired opening, such as an eyelet of a shoe, in a similar manner to that for the sheathed cord described hereinabove. When the tension is reduced, the elastic memory of the expandable component enables outward expansion thereof to a larger diameter which is sufficient to reversibly resist movement through the opening.

Figure 7:
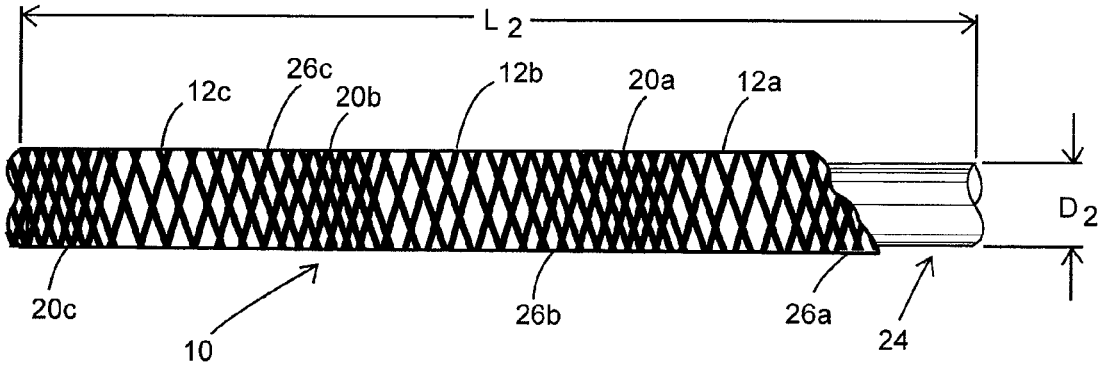
FIG. 7 is a schematic representation of a side elevational view, partially cut away, showing portions of an asymmetric tapered protruding portion embodiment of the sheathed elastic cord of the present invention, wherein the asymmetric protruding portions collapse when the cord is tensioned.

FIG. 7 is a schematic representation of a side elevational view, partially cut away, showing portions of an asymmetric tapered protruding portion embodiment of the sheathed elastic cord of the present invention, wherein the asymmetric protruding portions collapse when the cord is tensioned.

Figure 8:
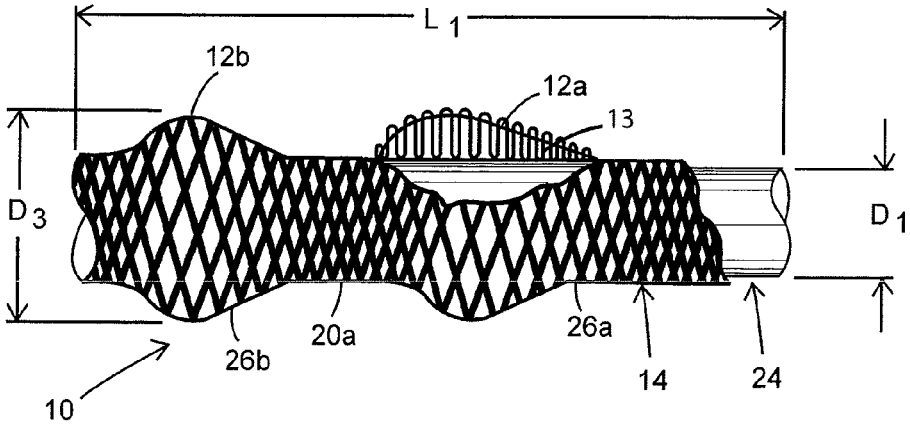
FIG. 8 is a schematic representation of a side elevational view similar to that of FIG. 7 hereof showing the sheathed elastic cord in an untensioned condition wherein the asymmetric tapered knots are fully formed.

FIG. 8 is a schematic representation of a side elevational view similar to that of FIG. 7 hereof showing the sheathed elastic cord in an untensioned condition wherein the asymmetric tapered knots are fully formed.

The asymmetric embodiment of FIGS. 7 and 8 may be formed in a similar manner to that of the symmetric embodiment of FIGS. 1-4, hereof. Again, first braid patterns 20*a* and 20*b* are tightly woven, constant weave patterns formed with a sufficiently tight braid to frictionally grip or anchor on the core when the core is relaxed. Second patterns, 26*a*-26*c* are formed on only one side (the same side) of protruding portions 12*a* and 12*b*, respectively, are weave patterns having decreasing density (increased spacing) of fibers from that of tightly woven braid patterns 20*a* and 20*b* until the center of protrusion 12*a* or 12*b* is reached. The fiber density is then rapidly increased (decreased spacing) until the fiber density of the tightly woven braid pattern on the other side of protruding portion 12*a* or 12*b* is attained. Again, these braids are sufficiently loose to enable sheath 14 to be detached from core 24, in these portions along core 24, as shown in FIG. 8, such that the bunching of sheath 14 in these portions form isolates when core 24 is permitted to relax.

Figure 9:
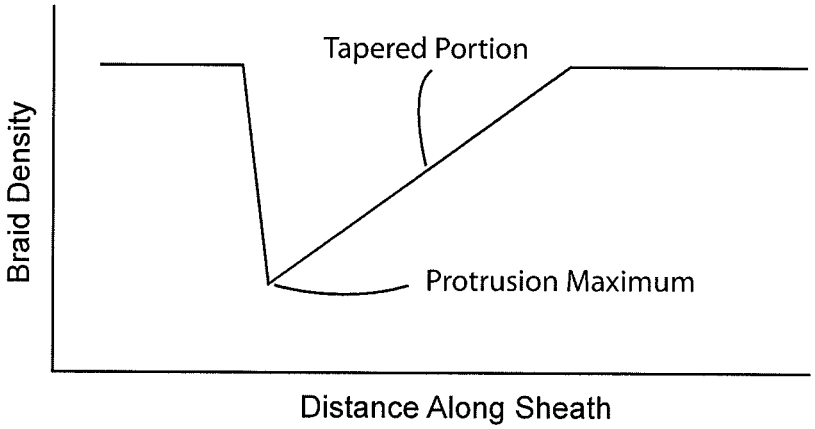
FIG. 9 is a graph of an example of the weave pattern density of the sheath as a function of the distance along the elastic cord for a chosen protruding portion which generates the asymmetric tapered protruding portions of FIGS. 7 and 8 hereof.

FIG. 9 is a graph of an example of the density of the weave of the sheath as a function of the distance along the elastic cord for a chosen protruding portion which generates the asymmetric tapered protruding portions of FIGS. 7 and 8 hereof. The tapered portions may be formed on either side of the protruding portions, and in patterns determined by the intended use of the elastic cord.

Figure 10:
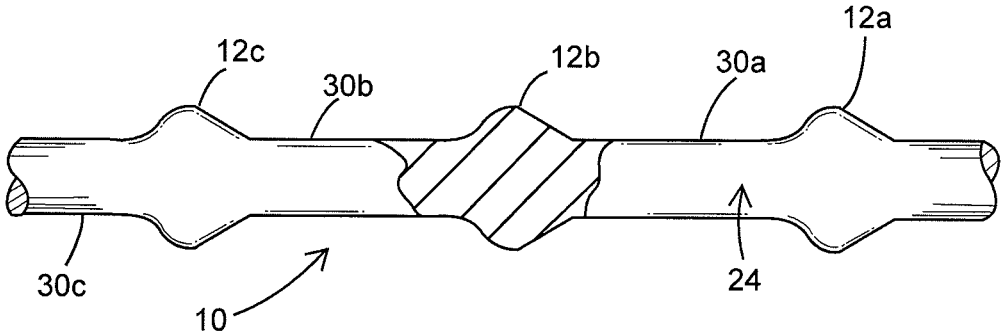
FIG. 10 is a schematic representation of a side elevation view of an unsheathed embodiment of the elastic cord of the present invention having asymmetric tapered protruding portions.

FIG. 10 is a schematic representation of a side elevation view of an unsheathed embodiment of elastic cord 10 of the present invention having asymmetric tapered protruding portions. As for the sheathed embodiment, the tapered portions may be formed on either side of the protruding portions, and in patterns determined by the intended use of the elastic cord.

Having generally described an embodiment of the invention, the following EXAMPLE provides additional details thereof.

EXAMPLE

An example in accordance with the invention for use as a shoestring is cord which, in an unstressed state, has the required length for threading through each of the eyelets of the shoe upper, for example 650 mm for an adult sized shoe with six eyelets on each side of the upper. The diameter of the core, and the spacing and size of the isolates depends on the intended application; running shoes and snowboarding shoes being examples. Typically, the isolates may have a diameter of about 2 times the diameter of the core of the cord, and are spaced 1 cm apart. The total width of the tapered portion of the isolate (including both sides of the isolate) may be equal to the diameter of the isolate. Each of the protrusions contracts to a size fitting closely about the elongated core sufficient to allow the cord to then be threaded through the eyelet. Standard yarns employed are 300 denier polyester, while performance yarns are 520 denier polyester.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An elongated cord for threading through an opening, said cord having an axis, comprising: an elastic core; and a sheath surrounding said elastic core forming at least two intermediate portions having a first diameter adapted to be threaded through the opening, and at least one outwardly expandable protruding portion having a second diameter at its largest extent when said core is unstretched, disposed between two of the at least two intermediate portions, said sheath comprising a flexible braided stranded material having a first braid pattern over the at least two intermediate portions which is sufficiently tight to frictionally anchor said sheath to said core, and a second braid pattern forming the at least one tapered protruding portion which is sufficiently loose to maintain an unanchored condition of the at least one protruding portion and said core, wherein the strands of said braided material have increasing strand spacing from the first braid pattern from a first of the at least two intermediate portions to the second diameter of the second braid pattern, and decreasing strand spacing between the second diameter and a second of the at least two intermediate portions, wherein the second diameter is reduced when said core is stretched a first amount, thereby enabling the at least one protruding portion to be drawn through the opening, and wherein the at least one protruding portion assumes a third diameter at its largest extent, less than or equal to the second diameter, effective for resisting movement of the at least one protruding portion through the opening responsive to said core being stretched a second amount less than the first amount, wherein the two intermediate portions move towards each other.

2. The cord of claim 1, wherein the strands of said braided material have linearly increasing strand spacing from the first braid pattern from a first of the at least two intermediate portions to the second diameter of the second braid pattern, and linearly decreasing strand spacing between the second diameter and a second of the at least two intermediate portions.

3. The cord of claim 1, wherein said sheath is bonded to said core over at least a portion of the at least two intermediate portions.

4. The cord of claim 3, wherein the bond is chosen from at least one adhesive, a sonic bond, a heat fusion bond, stitching, at least one staple, and a band wrapped around the sheath sufficiently tight to cause frictional engagement between said sheath and said core.

5. The cord of claim 1, wherein said core comprises an elastomeric material.

6. The cord of claim 5, wherein said elastomeric material is chosen from butyl rubber, neoprene, and ethylene vinyl acetate.

7. The cord of claim 1, wherein said core comprises elastic fibers.

8. The cord of claim 1, wherein said core comprises elastic fibers blended or woven with fibers effective for increasing the tensile strength thereof.

9. The cord of claim 8, wherein the blended or woven fibers comprise nylon fibers.

10. The cord of claim 1, wherein said braided stranded material is chosen from cotton, polyester, nylon, acrylic and elastic material.

11. An elongated cord for threading through an opening, said cord having an axis, comprising: an elastic core; and a sheath surrounding said elastic core forming at least two intermediate portions having a first diameter adapted to be threaded through the opening, and at least one outwardly expandable protruding portion having a second diameter at its largest extent when said core is unstretched, disposed between two of the at least two intermediate portions, said sheath comprising a flexible braided stranded material having a first braid pattern over the at least two intermediate portions which is sufficiently tight to frictionally anchor said sheath to said core, and a second braid pattern forming the at least one tapered protruding portion which is sufficiently loose to maintain an unanchored condition of the at least one protruding portion and said core, wherein the strands of said braided material have increasing strand spacing from the first braid pattern from a first of the at least two intermediate portions to the second diameter of the second braid pattern, and decreasing strand spacing between the second diameter and a second of the at least two intermediate portions, whereby the at least one protruding portion is asymmetrical, and wherein the second diameter is reduced when said core is stretched a first amount, thereby enabling the at least one protruding portion to be drawn through the opening, and wherein the at least one protruding portion assumes a third diameter at its largest extent, less than or equal to the second diameter, effective for resisting movement of the at least one protruding portion through the opening responsive to said core being stretched a second amount less than the first amount, wherein the two intermediate portions move towards each other.

12. The cord of claim 11, wherein said sheath is bonded to said core over at least a portion of the at least two intermediate portions.

13. The cord of claim 12, wherein the bond is chosen from at least one adhesive, a sonic bond, a heat fusion bond, stitching, at least one staple, and a band wrapped around the sheath sufficiently tight to cause frictional engagement between said sheath and said core.

14. The cord of claim 11, wherein said core comprises an elastomeric material.

15. The cord of claim 14, wherein said elastomeric material is chosen from butyl rubber, neoprene, and ethylene vinyl acetate.

16. The cord of claim 11, wherein said core comprises elastic fibers.

17. The cord of claim 11, wherein said core comprises elastic fibers blended or woven with fibers effective for increasing the tensile strength thereof.

18. The cord of claim 17, wherein the blended or woven fibers comprise nylon fibers.

19. The cord of claim 11, wherein said braided stranded material is chosen from cotton, polyester, nylon, acrylic and elastic material.

* * * * *